US005116266A

United States Patent [19]

Seymour et al.

[11] Patent Number: 5,116,266

[45] Date of Patent: May 26, 1992

[54] ELECTRICAL CONNECTOR

[75] Inventors: Douglas G. Seymour; Randall E. Gillotti, both of Warren, Pa.

[73] Assignee: GTE Products Corporation, Stamford, Conn.

[21] Appl. No.: 110,156

[22] Filed: Oct. 19, 1987

[51] Int. Cl.[5] ..... H01R 11/22

[52] U.S. Cl. ..... 439/851; 439/842

[58] Field of Search ..... 439/389–414, 439/842, 846, 852–857, 850, 851

[56] References Cited

U.S. PATENT DOCUMENTS 3,566,342 2/1971 Schmitt et al. ..... 439/852
3,963,302 6/1976 Gourley ..... 439/851
4,032,215 6/1977 Jarmofsky et al. ..... 439/852
4,298,242 11/1981 McKee ..... 439/851
4,669,798 6/1987 Daum et al. ..... 439/423
4,687,278 8/1987 Grabbe et al. ..... 439/842
4,874,338 10/1989 Bakermans ..... 439/851

FOREIGN PATENT DOCUMENTS 0087894 9/1983 European Pat. Off. ..... 439/852

*Primary Examiner*—David L. Pirlot
*Attorney, Agent, or Firm*—William H. McNeill

[57] ABSTRACT

An electrical connector wherein the contacts are formed as a quadrangular tube having inwardly projecting beams formed in two opposed walls.

7 Claims, 2 Drawing Sheets

ELECTRICAL CONNECTOR

TECHNICAL FIELD

This invention relates to electrical connectors and more particularly to such connectors comprised of a plurality of electrically conductive contacts contained in an insulating housing.

BACKGROUND ART

Prior electrical connectors tend to be large and bulky and difficult to employ. The contacting tines, which can be single, or double as shown in U.S. Pat. No. 3,178,669, are exposed during manufacture and subject to bending and subsequent misalignment.

SUMMARY OF THE INVENTION

It is, therefore, an object of this invention to obviate the disadvantages of the prior art.

It is another object of the invention to enhance electrical connectors.

These objects are accomplished, in one aspect of the invention, by the provision of an electrical connector which comprises a housing of electrically insulating material having a plurality of cavities therein. An electrically conductive contact is positioned in each of the cavities. Each of the contacts has a first end and a second end with the first end being formed to provide a substantially quadrangular tube having two pairs of diametrically opposed sides. Two contact beams or tines are formed with one of the pairs of sides, one beam on each of the opposed sides. The beams project inwardly toward the center of the tube.

This construction offers protection for the beams during assembly and also allows close spacing of adjacent contacts, thus reducing the size and bulk of the connector.

DESCRIPTION OF THE PREFERRED EMBODIMENT

For a better understanding of the present invention, together with other and further objects, advantages and capabilities thereof, reference is made to the following disclosure and appended claims taken in conjunction with the above-described drawings.

Figure 1:
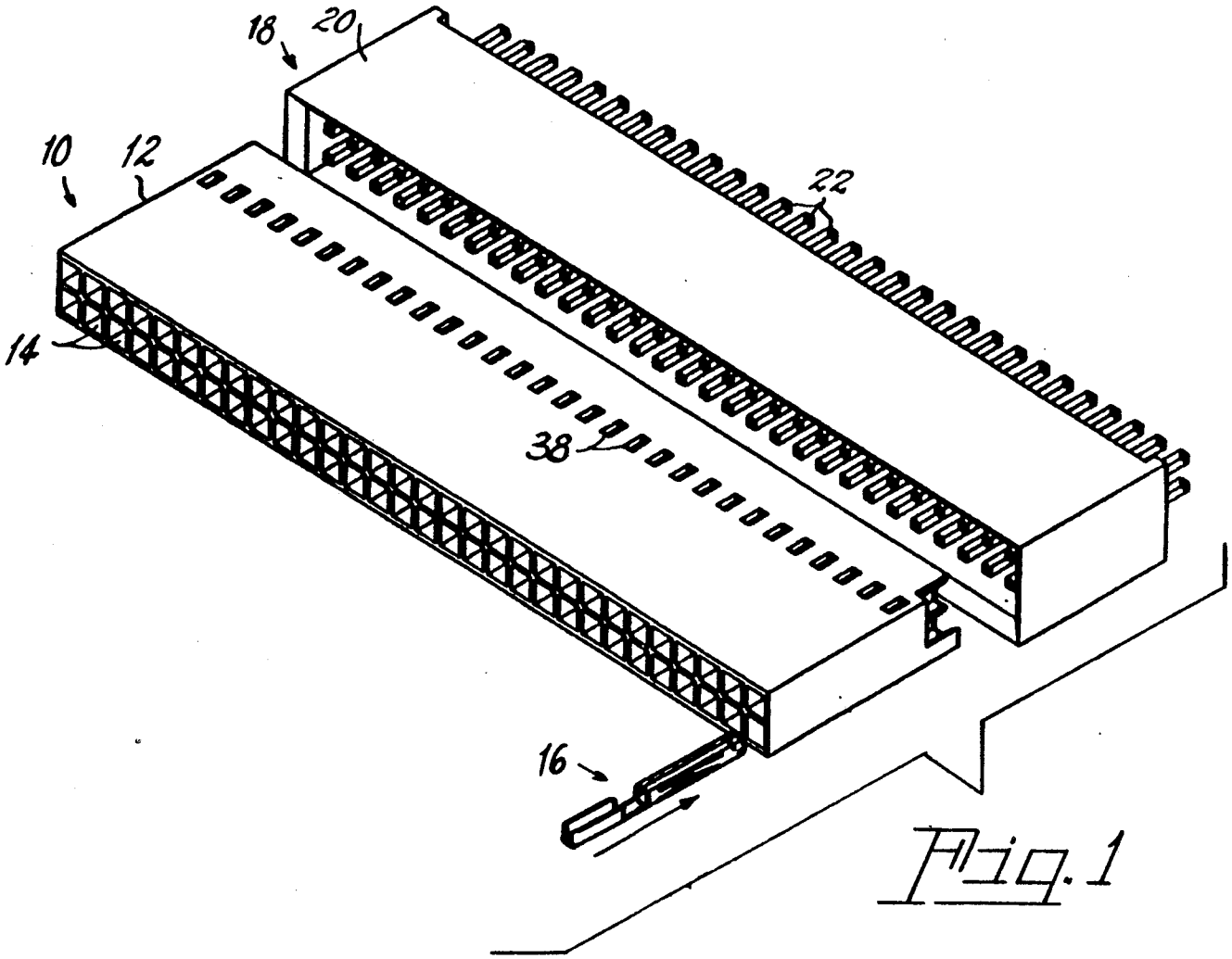
FIG. 1 is an exploded, perspective view of an electrical connector and an associated header assembly with a single contact outside the housing.

Referring now to the drawings with greater particularity, there is shown in FIG. 1 an electrical connector 10 having a housing 12 of electrically insulating material. The housing contains a plurality of cavities 14 for receiving electrical contacts 16, one of which is shown in FIG. 1. The connector 10 can be mated with a header assembly 18 which can be comprised of an insulating housing 20 mounting a plurality of electrically conductive posts 22.

The contact 16 (see FIG. 2) has a first end 24 and a second end 26 formed to receive and hold an electrically conductive wire 28, as by means of an insulation displacement crimp 30.

The first end 24 is formed as a substantially quadrangular tube having two pairs of diametrically opposed sides, 32, 34 respectively. One of said pairs; e.g., 34, has two contact beams 36 formed therewith, one beam 36 on each of said opposed walls. The beams 36 project inwardly toward the center of the tube and are thus protected from damage during assembly.

Figures 2, 3, 4:
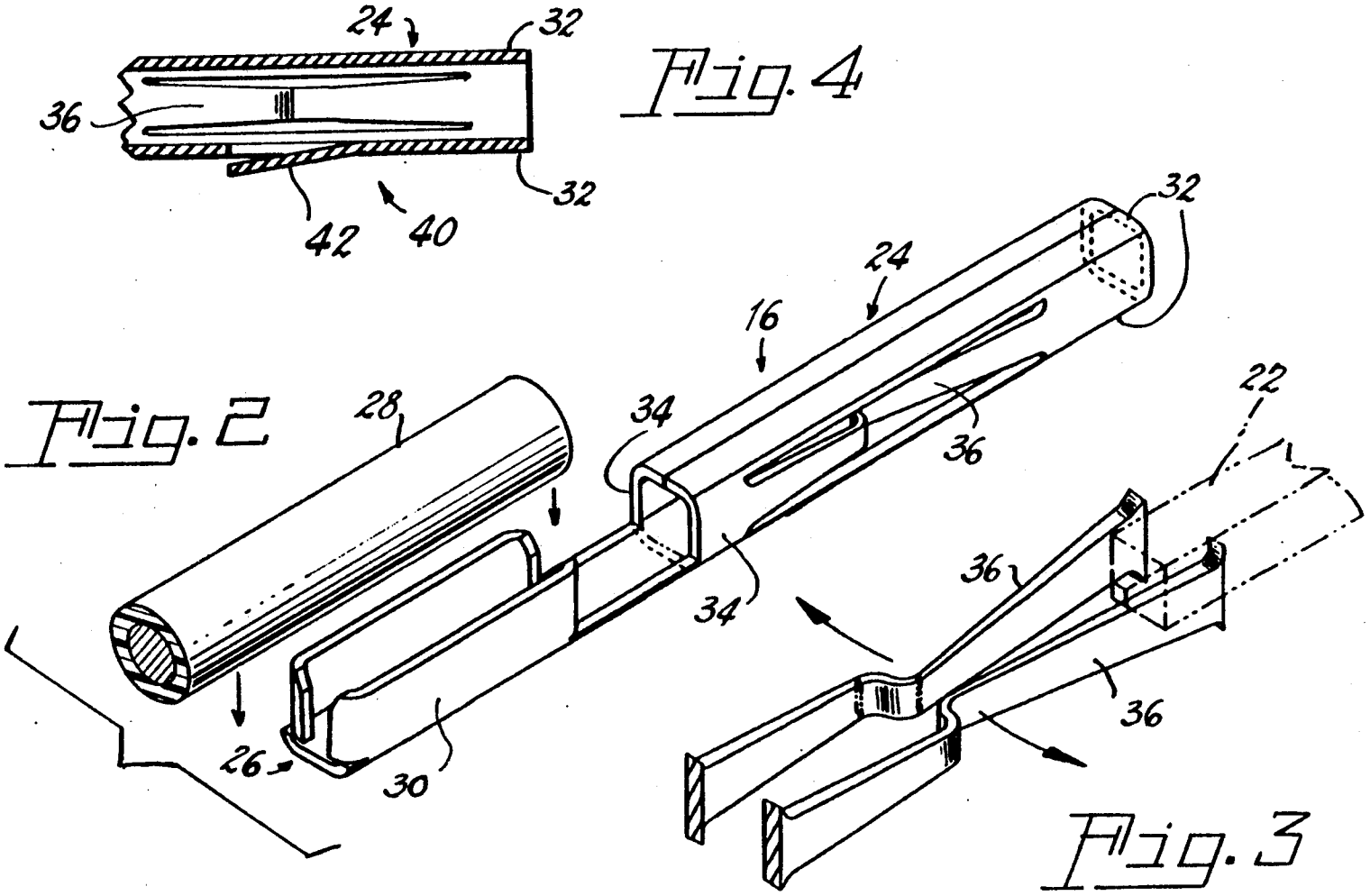
FIG. 2 is a perspective view of a contact in accordance with the invention.
FIG. 3 is a partial enlarged, perspective view of the beams of the contact.
FIG. 4 is a partial, elevational, sectional view of a contact illustrating a locking means.

FIG. 3 illustrates the manner in which the beams 36 move upon engagement with a post 22 when connector 10 is mated with header assembly 18.

The housing 12 includes a locking receptacles 38 associated with each cavity to co-operate with locking means 40 formed on the contacts 16 to retain the contacts in the housing. In the embodiment shown, the locking receptacle is a thru slot in each cavity and the locking means comprises a lanced tongue 42 formed in wall of the first end 24 not having a contact beam formed therein; e.g., one of the walls 32.

To assemble the connector 10 a suitable number of discrete wires 28 (or flat cable wire) is terminated to a like number of contacts 16 via the insulation displacement crimp 30. When the wires are terminated, the contacts 16 are inserted into cavities 14 until the locking tongue 42 engages the locking receptacle 38. Individual repair or replacement can be accomplished by inserting a tool into the thru slot, depressing the tongue 42 and withdrawing the contact.

There is thus provided a new electrical connector which is smaller than the prior art connectors and which provides increased protection for the contact beams during assembly.

While there has been shown and described what is at present considered to be the preferred embodiment of the invention, it will be apparent to those skilled in the art that various changes and modifications can be made herein without departing from the scope of the invention as defined by the appended claims.

We claim:

1. An electrical connector comprising: a housing of electrically insulating material containing cavities; and an electrically conductive female contact positioned in each of said cavities, said female contact having a first end and a second end, said first end being formed to provide a substantially quadrangular tube having two pairs of diametrically opposed sides, and two contact beams formed with one of said pairs, one on each of said opposed sides, said beams being formed to provide electrical connection with an inserted male contact pin and being connected to said sides from which they are formed at each of their ends; each of said beams having a variable height measured parallel to said side, the widest portion of said beams being where said beams join said sides and the narrowest portion of said beams projecting inwardly toward the center of said tube where said narrowest portions of said beams will contact said inserted male contact pin.

2. The electrical connector of claim 1 wherein said second end is formed to receive and hold an electrically conductive wire.

3. The electrical connector of claim 1 wherein said second end is formed to provide an insulation displacing crimp.

4. The electrical connector of claim 1 wherein said first end is formed to receive a square post.

5. The electrical connector of claim 1 wherein said housing includes a locking receptacle associated with each cavity and each of said contacts is formed to provide locking means which cooperate with said locking receptacle.

6. The electrical connector of claim 5 wherein said locking means comprises a tongue.

7. An electrically conductive female contact comprising: a first end and a second end, said first end being formed to provide a substantially quadrangular tube having two pairs of diametrically opposed sides, and two contact beams formed with one of said pairs, one on each of said opposed sides, said beams being formed to provide electrical connection with an inserted male contact pin and being connected to said sides from which they are formed at each of their ends; each of said beams having a variable height measured parallel to said side, the widest portion of said beams being where said beams join said sides and the narrowest portion of said beams projecting inwardly toward the center of said tube where said narrowest portions of said beams will contact said inserted male contact pin.

* * * * *